United States Patent [19]

Martin

[11] Patent Number: 4,907,552

[45] Date of Patent: Mar. 13, 1990

[54] FORCED AIR INDUCTION SYSTEM

[76] Inventor: Chans A. Martin, Rte. 3, Box 125, Clovis, N. Mex. 88101

[21] Appl. No.: 330,760

[22] Filed: Mar. 30, 1989

[51] Int. Cl.[4] ..... F02B 77/00

[52] U.S. Cl. ..... 123/198 E; 123/559.1; 55/473

[58] Field of Search ..... 123/198 E, 559.1; 60/605.1; 55/473

[56] References Cited

U.S. PATENT DOCUMENTS

| | | | |
|---|---|---|---|
| 2,254,927 | 9/1941 | Archambeau | 123/559.1 |
| 2,362,493 | 11/1944 | Lowther | 123/559.1 |
| 2,610,701 | 9/1952 | Goldberg et al. | 55/473 |
| 2,681,646 | 6/1954 | Holpfer | 123/559.1 |
| 2,839,038 | 6/1958 | Middlebrooks, Jr. | 123/559.1 |
| 3,791,113 | 2/1974 | Elder | 55/473 |
| 4,204,848 | 5/1980 | Schulmeister et al. | 55/473 |
| 4,233,043 | 11/1980 | Catterson | 55/473 |
| 4,319,657 | 3/1982 | Nomura | 180/219 |
| 4,482,024 | 11/1984 | Matsuda et al. | 18/219 |
| 4,482,365 | 11/1984 | Roach | 55/473 |

*Primary Examiner*—N. Kamen

*Attorney, Agent, or Firm*—Fleit, Jacobson, Cohn, Price, Holman & Stern

[57] ABSTRACT

A forced air induction system is provided in an air box of an ATV. A fan is installed in the air box adjacent to an enlarged air inlet. The fan sucks air into the air box and pushes air through the air box and through an air filter to a downstream carburetor. This pressurized air to the carburetor produces a boost in power, acting as a supercharger for the ATV to thereby increase horsepower delivered. The continuous pressurized air flow results in at least a 20% increase in power output by the ATV.

8 Claims, 3 Drawing Sheets

FORCED AIR INDUCTION SYSTEM

FIELD OF THE INVENTION

This invention relates to a forced air induction system for an all-terrain vehicle.

BACKGROUND OF THE INVENTION

Motorcycle-type vehicles having three or four wheels and which are used for off-road as well as on-road use have obtained the name of all-terrain vehicle (ATV). Recently, concern has been expressed with respect to the safety of the three-wheel version of ATVs. In response to this concern, only four-wheel ATVs are presently available for sale to the public as original equipment.

With the concern for the safety of these vehicles being addressed by the limitation of sale to the four-wheel model, a resurgence in the popularity of ATVs has been experienced. However, four-wheel ATVs, as well as the older model three-wheel ATVs have been plagued by the problem of a lack of power available to the sports enthusiast during off-road use.

SUMMARY OF THE INVENTION

By the present invention, a forced air induction system is provided in an air box of an ATV. A fan is installed in the air box adjacent to an enlarged air inlet of the air box, but distally from the engine. The fan sucks air into the air box and pushes air through the air box and through an air filter to a downstream carburetor or air fuel mixer. This pressurized air to the carburetor produces a boost in power, acting as a supercharger for the ATV to thereby increase delivered horsepower. The continuous pressurized air flow results in at least a 20% increase in power output by the ATV.

It is an object of the present invention to augment power available to an all-terrain vehicle.

It is another object of the present invention to include an electrically powered fan in an air box of an ATV to push air towards a carburetor.

It is yet another object of the present invention to augment power for an ATV by providing an electrical fan downstream of an air inlet opening of an air box and upstream from an air filter, and upstream from a carburetor for maintaining a continuous, pressurized air flow towards and into the carburetor.

These and other objects of the invention, as well as many of the advantages thereof, will become more readily apparent when reference is made to the following description taken in conjunction with the accompanying drawings.

DETAILED DESCRIPTION OF THE PREFERRED EMBODIMENTS

Figure 1:
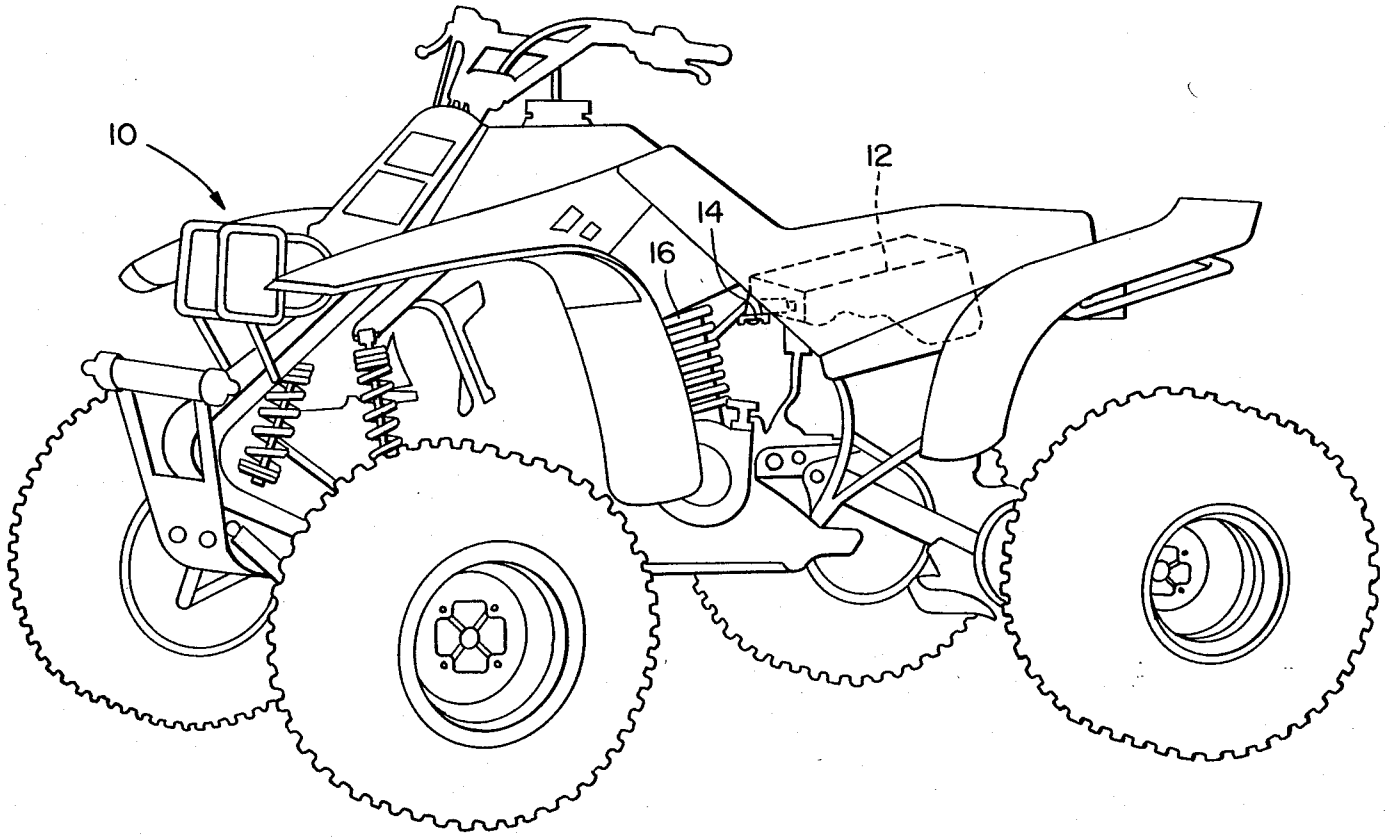
FIG. 1 is a schematic view of an all-terrain vehicle.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1 in particular, an all-terrain vehicle embodying the teachings of the subject invention is generally designated as 10. In FIG. 1, a four-wheeled ATV is shown. However, it is to be understood that the present invention is equally applicable to a three-wheeled ATV as well as to a two-wheeled motorcycle.

In FIG. 1, a forced air induction system is shown as including air box 12, through which air is drawn for combination with fuel in the carburetor so as to provide an air/fuel mixture to a cylinder head so as to power the vehicle. Air box 12 is located under the seat of the vehicle. Carburetor 14 is connected to and located downstream from air box 12. Similarly, cylinder head 16 is located downstream from and connected to carburetor 14. Carburetor 14 and cylinder head 16 are located below the seat of the vehicle and between the knees of the operator straddling the vehicle. As shown, the space allotted for the air box, carburetor and cylinder head is very limited.

Figure 2:
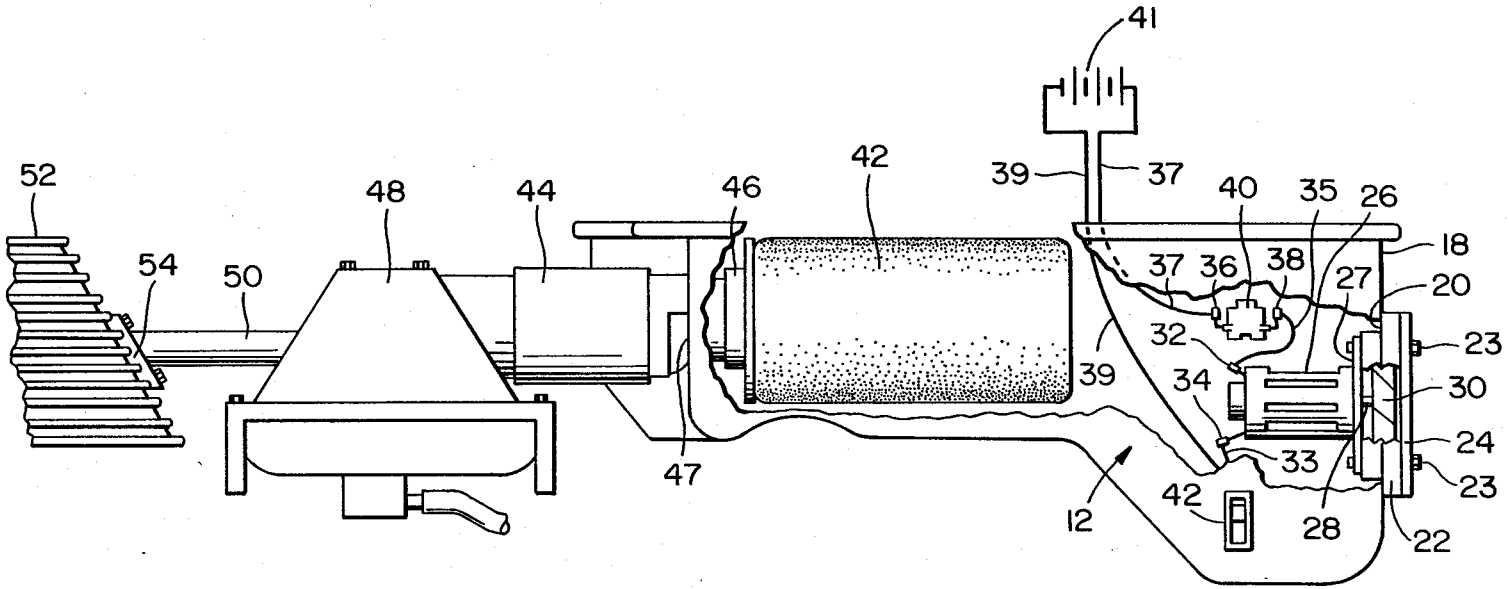
FIG. 2 is a side, partial cut-away view of a forced air induction system for an ATV.

With reference to FIG. 2, the components of the forced air induction system are shown. The air box 12 is shown in partial cut-away section so as to illustrate the internal components located inside the air box.

Figure 3:
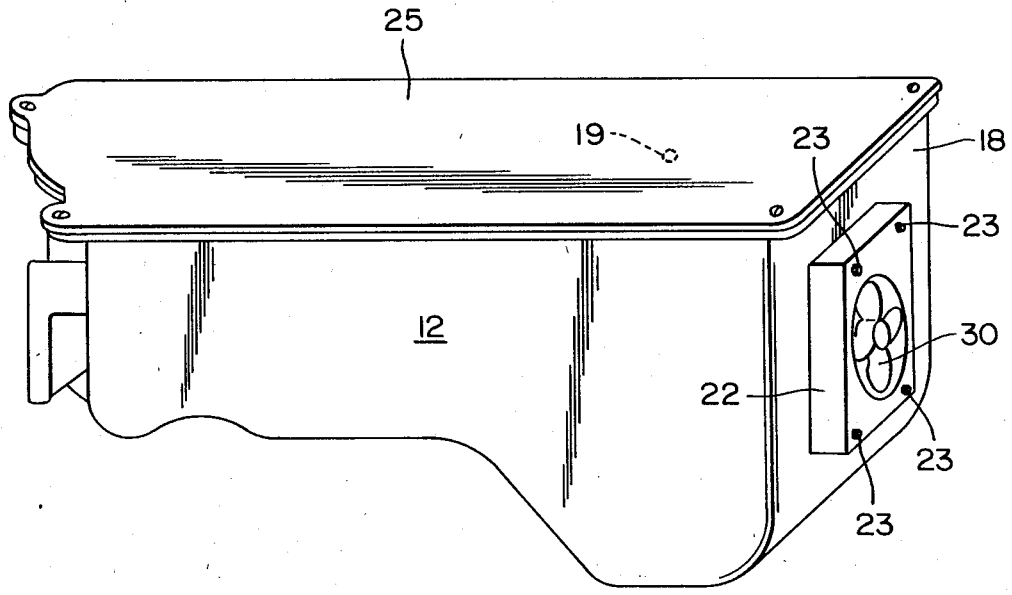
FIG. 3 is a perspective view of an air box of an ATV.

Normally, a small air inlet 19, shown in phantom in FIG. 3, is formed on top of the air box and allows air to passively flow into the air box. For the purposes of this invention, the small air hole is plugged and a larger diameter air hole is formed in end wall 18 of the air box which is shown as opening 20. Opening 20 is preferably three to four inches in diameter. Mounting block 22 extends beyond the outer edge of opening 20 and is secured on end wall 18. Secured onto the exterior of mounting block 22 is a pre-air cleaner 24 designed to remove large particles of dust.

In FIG. 3, mounting block 22 is shown secured to end wall 18 of air box 12 by bolts 23. Air box 12 is sealed by cover 25.

On the opposite side of the mounting block 22, in the interior of the air box 12, is mounted a 6-volt motor 26 designed to withstand vibration and dust. Motor 26 is mounted on plate 27 which is secured to end wall 18 by bolts 23. Mounted on a shaft 28 of the motor 26 is a fan 30 that is designed for maximum air flow and air pressure through the pre-air cleaner 24 into the interior of the air box 12. Pre-air cleaner 24 is mounted on the exterior of mounting block 22 by bolts 23. Pre-air cleaner 24 is omitted from FIG. 3 for purposes of clarity and to illustrate fan 30.

The motor 26 includes two leads 32 and 34 which are, in practice, connected with the leads 36 and 38 of a 12-volt to 6-volt, 4-amp regulator 40 which is, in practice, connected to the power supply or battery for the vehicle. An on/off switch 42 is also connected in the circuit from the power supply for the vehicle for control by the rider of the vehicle of the forced air induction system. Wire 33 connects switch 42 to terminal 34, wire 35 connects lead 32 to lead 38, wire 37 connects lead 36 to power source 41, as does wire 39 from switch 42.

Downstream from the fan 30 and motor 26 is a foam air cleaner 42. Air is sucked in through pre-air cleaner 24 and opening 20 and then forced or pushed into air cleaner 42 which is located downstream from the fan and motor along an air flow path.

A pipe 44 located downstream from the air cleaner 42 along the air flow path is connected by coupling 46 to an opening 47 of the air box which is blocked by air cleaner 42. Openings 20 and 47 are the only openings in the air box for the flow of air.

Pipe 44 is connected at its downstream end along the air flow path to carburetor 48 which mixes the fuel supply and air forced towards it by the fan and motor 30 and 26. A hose 50 is connected at one end to the carburetor 48 and at its opposite end is connected to the cylinder head 52 by coupling 54. Hose 50 is not usually more than two inches in length due to the limited space for the components of the air induction system. The cylinder head 52 is where the cylinder, pistons and valves in a 4-stroke engine, are encased.

By the sucking-in of air along an air flow path which is initiated by passing through pre-air cleaner 24 by the rotation of the fan blades 30, air is pressurized in the air box and forced through air cleaner 42 to pipe 44, to carburetor 48, to hose 50 and ultimately to cylinder head 52. By the pressurized air flow of the forced air induction system, the piston in the cylinder head sucks in more air during its downstroke to increase compression and thereby increase horse power.

Having described the invention, many modifications thereto will become apparent to those skilled in the art to which it pertains without deviation from the spirit of the invention as defined by the scope of the appended claims.

I claim:

1. A forced air induction system comprising: an air box which is sealed except for two openings therein, fan means secured in one of said two openings of said air box for sucking air into said air box through said one opening, an air cleaner located within said air box and blocking the other of said two openings for filtering air sucked into said air box through said one opening by said fan means and pushed by said fan means through said air cleaner and out said other opening of said air box, and wherein an air-fuel mixer is located downstream from said air box in the flow path of air through said air box.

2. A forced air induction system according to claim 1, wherein said fan means is mounted on a wall of said air box.

3. A forced air induction system according to claim 2, wherein a pre-air cleaner is mounted outside of said air box so that air sucked into said air box by said fan means passes through said pre-air cleaner.

4. A forced air induction system according to claim 1, wherein a cylinder head is located downstream from said air-fuel mixer in the flow path of air through said air box.

5. A forced air induction system for an all-terrain vehicle, said system comprising:

an air box, two openings defined by said air box, fan means secured in one of said two openings for sucking air into said air box through said one opening, said fan means is located distally from an engine, an air cleaner located downstream along an air flow path from said fan means, the other of said two openings being located downstream from said air cleaner along said air flow path, a air-fuel mixer located downstream along said air flow path from said other opening, pipe means for connecting said air-fuel mixer and said other opening, a cylinder head of said engine located downstream along said air flow path from said air-fuel mixer, and hose means for connecting said cylinder head and said air-fuel mixer, said air flow path being defined by air sucked into said air box by said fan means and pushed through said air cleaner to said other opening, through said pipe means to said air-fuel mixer and through said hose means to said cylinder head.

6. A forced air induction system according to claim 5, wherein a pre-air cleaner is located upstream along said air flow path from said fan means so that air sucked into said air box by said fan means is filtered.

7. A forced air induction system according to claim 6, wherein said cylinder head includes a piston reciprocatingly mounted in a cylinder, and said piston receiving air pushed by said fan means during a downstroke.

8. A forced air induction system according to claim 5, wherein said two openings are located at opposite ends of said air box.

* * * * *